US005276283A

United States Patent [19]

Ballentine et al.

[11] Patent Number: 5,276,283

[45] Date of Patent: Jan. 4, 1994

[54] DISTRIBUTOR CAP

[75] Inventors: Richard E. Ballentine, Anderson; James R. Tumulty, Yorktown; James A. Boyer, Anderson, all of Ind.

[73] Assignee: General Motors Corporation, Detroit, Mich.

[21] Appl. No.: 28,201

[22] Filed: Mar. 8, 1993

[51] Int. Cl.[5] ..... H01H 19/00; F02P 7/02

[52] U.S. Cl. ..... 200/19 DC

[58] Field of Search ..... 200/19R, 190C, 19WG; 123/146.5R, 146.5A

[56] References Cited

U.S. PATENT DOCUMENTS

| | | | |
|---|---|---|---|
| 2,169,595 | 8/1939 | Sherman | 200/19 DC |
| 2,174,081 | 9/1939 | Fitzsimmons | 200/19 DC |
| 2,246,901 | 6/1941 | Schwarzmann | 200/19 DC |
| 3,435,161 | 3/1969 | Webster | 200/26 |
| 3,504,141 | 3/1970 | Webster | 200/25 |
| 3,591,736 | 7/1971 | Morgan | 200/19 DC |
| 3,646,922 | 3/1972 | Spalding | 123/407 |
| 4,045,636 | 8/1977 | Yoder et al. | 200/292 |
| 4,182,940 | 1/1986 | Scussel et al. | 200/19 R |
| 4,897,514 | 1/1990 | Arima et al. | 200/19 DC |
| 5,028,747 | 7/1991 | Ballentine et al. | 200/19 DC |

*Primary Examiner*—J. R. Scott

*Attorney, Agent, or Firm*—Creighton R. Meland

[57] ABSTRACT

A distributor cap for an ignition distributor. The cap is formed of electrical insulating material. A plurality of electrical connector and terminal assemblies are molded into the cap. Each assembly is comprised of a length of plastic moldable material that supports a metallic insert and a metallic terminal. The ends of the length of plastic material are molded respectively to the insert and the terminal. The length of plastic material is plated or coated with a metallic material such as aluminum and this material also coats portions of the terminal and insert. The metallic coating on the length of plastic material electrically connects the terminal to the insert.

12 Claims, 2 Drawing Sheets

DISTRIBUTOR CAP

This invention relates to a distributor cap for internal combustion engine ignition distributors.

Distributor caps for ignition distributors that have terminals that extend radially of the cap are known, an example being the distributor cap shown in the U.S. Pat. No. to Ballentine et al. 5,028,747. The distributor cap shown in that patent utilizes ink traces to connect spark plug terminals to inserts or electrodes of the cap.

The distributor cap of this invention differs from the cap shown in the above referenced U.S. Pat. No. 5,028,747 in that, among other things, the spark plug terminals are connected to respective electrodes or inserts of the distributor cap by lengths of conductors where each conductor is a coating or plating of electrically conductive material that is located on the outside of a length of plastic material. More specifically, a metallic spark plug terminal and a metallic insert are molded into opposite ends of a length of plastic material. The length of plastic material is plated or coated with an electrically conductive material, such as aluminum, and the electrically conductive material is also plated onto a part of the spark plug terminal and a part of the insert. The plated electrically conductive material therefore electrically connects a spark plug terminal to an insert. After the plating has been completed, the assembly is molded into the plastic material of the distributor cap.

In a preferred method of manufacturing, the distributor cap of this invention a lead frame that is formed of a molded plastic material is made. This lead frame is comprised of lengths of cylindrical plastic material that are joined together. The ends of certain lengths of plastic material are molded respectively to a spark plug terminal and to a cap insert. The lead frame is now plated or coated with an electrically conductive material and the plating or coating is done such that it contacts respectively a spark plug terminal and an insert to thereby electrically connect the terminal to the insert. Portions of the coated lead frame are now severed from the lead frame leaving a plurality of terminal and electrical connector assemblies. Each assembly is comprised of a spark plug terminal and an insert that are connected by a length of cylindrical plastic material. The length of plastic material has the electrically conductive coating which electrically connects the spark plug terminal and the insert. The assemblies are now molded into the plastic material of a distributor cap to form a complete distributor cap.

IN THE DRAWINGS

Figure 1:
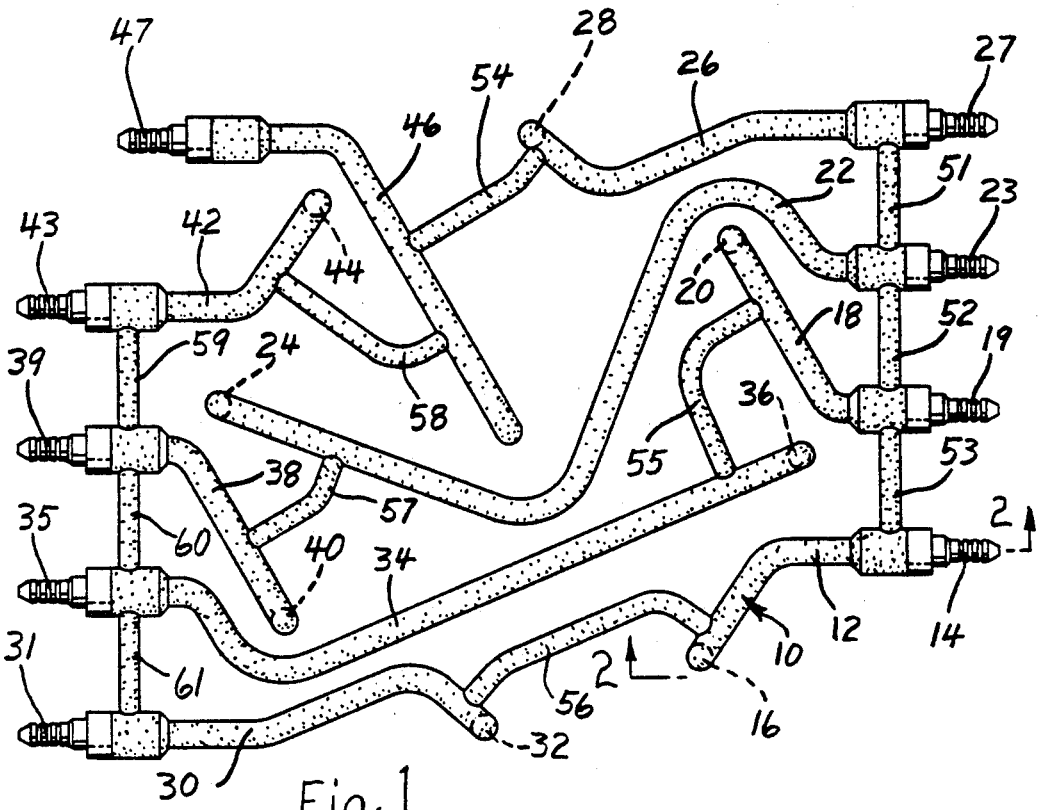
FIG. 1 is a top view of a lead frame that is utilized in the manufacture of the distributor cap of this invention.
Figure 2:
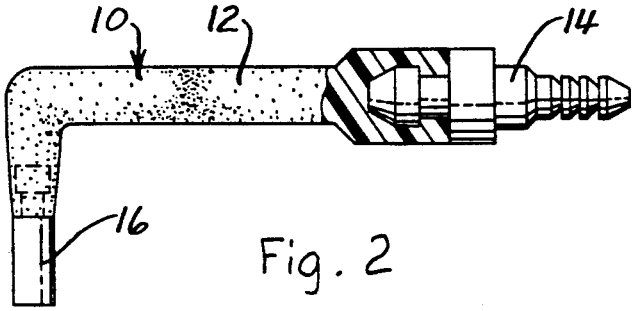
FIG. 2 is a view, partly in section, looking in the direction of line 2—2 shown in FIG. 1.

Referring now to the drawings and more particularly to FIG. 1, a lead frame is illustrated that serves as a support for a plurality of terminals and a plurality of distributor cap electrodes or inserts. The lead frame is formed of moldable plastic insulating material and is a one-piece plastic molded part. The lead frame has a section or portion 10 which is shown in FIGS. 1 and 2. The portion 10 is comprised of a length of molded plastic circular material 12 that is molded at its opposite ends to a metallic spark plug terminal 14 and to a metallic insert or electrode 16 by insert molding.

The lead frame further has a portion 18 that is molded to terminal 19 and insert 20, a portion 22 that is molded to terminal 23 and insert 24, a portion 26 that is molded to terminal 27 and insert 28, a portion 30 that is molded to terminal 31 and insert 32, a portion 34 that is molded to terminal 35 and insert 36, a portion 38 that is molded to terminal 39 and insert 40, a portion 42 that is molded to terminal 43 and insert 44 and a portion 46 that is molded to terminal 47.

The portions of the lead frame that have just been described are interconnected by lengths of plastic lead frame material designated respectively as 51, 52, 53, 54, 55, 56, 57, 58, 59, 60 and 61. As will be described hereinafter, the portions 51—61 are severed or broken away after the lead frame has been plated with a conductive material as will now be described.

Figure 3:
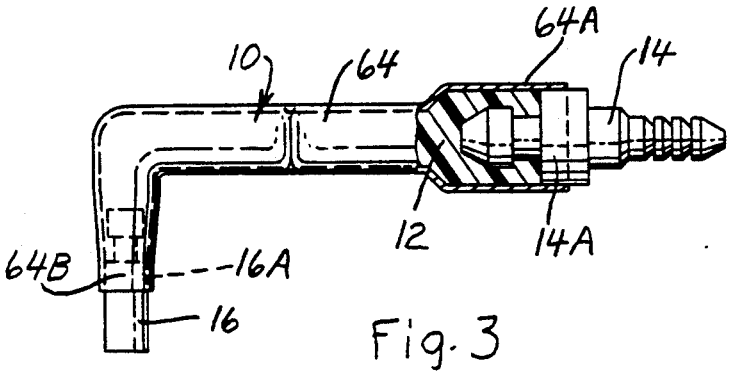
FIG. 3 is a view similar to FIG. 2, but illustrating a portion of the lead frame plated with an electrically conductive material.

When the lead frame shown in FIG. 1 has been made, it is entirely plated or coated with a metallic electrically conductive material such as aluminum. After plating, the plastic lead frame portions all have a cylindrical coating of aluminum material that surrounds or encircles the lead frame portions. Further, the coating or plating of aluminum material extends over end portions of the terminals and inserts to thereby electrically connect a terminal to an insert. This is depicted in FIG. 3, which shows portion or section 10 after it has been plated with conductive material. In FIG. 3, the reference numeral 64 designates the coating of aluminum material which is bonded to the length of plastic material 12. Coating or plating 64 has a portion 64A that contacts portion 14A of terminal 14 and a portion 64B that contacts portion 16A of insert 16. Portion 64A is bonded to portion 14A of terminal 14 and portion 64B is bonded to portion 16A of insert 16. Terminal 14 and insert 16 can both be formed of aluminum. The other portions of the lead frame are plated in the same manner as has been described in connection with the plating of portion 10, shown in FIG. 3.

After the lead frame has been entirely plated, the sections or portions 51-61 are broken away or severed from the other portions of the lead frame. As a result of this, portions 10, 18, 22, 26, 30, 34, 38, 42 and 46 are now separate plated parts that can be molded into the plastic material of a distributor cap.

Figure 4:
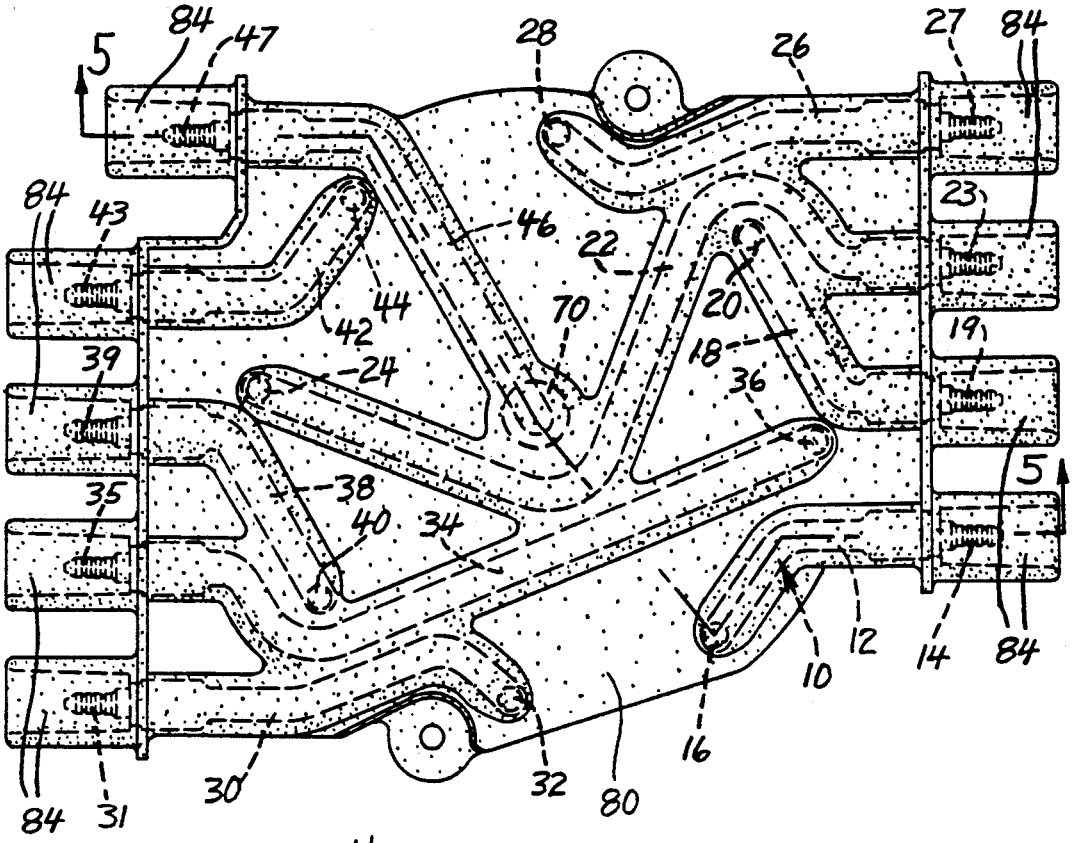
FIG. 4 is a top view of a distributor cap made in accordance with this invention.
Figure 5:
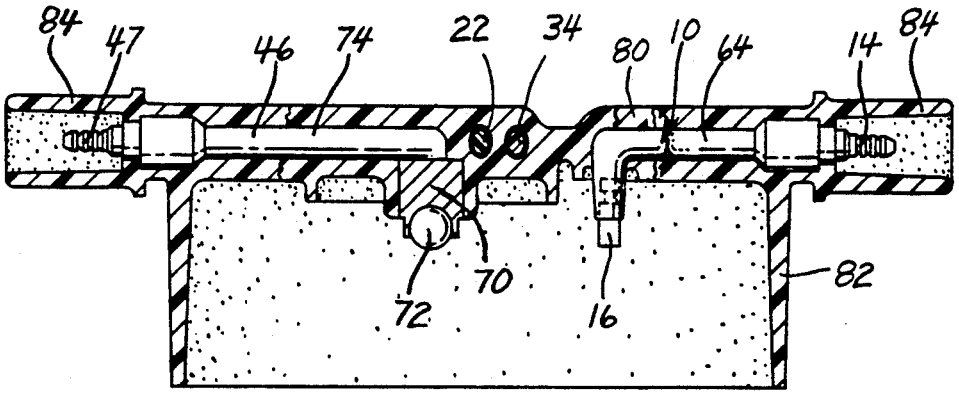
FIG. 5 is a sectional view taken along line 5—5 of FIG. 4.

FIGS. 4 and 5 shown the completed distributor cap after the portions 10, 18, 22, 26, 30, 34, 38, 42 and 46 have been molded into plastic cap molding material. It can be seen from FIG. 5 that the completed distributor cap has a center contact assembly comprised of metallic insert 70 and a spherical carbon ball 72 that is carried by insert 70. Prior to molding the cap material to the sections or portions, a portion of the metallic coating 74 on portion 46 is connected to insert 70. The portions 10, 18, 22, 26, 30, 34, 38, 42 and 46 are placed in a mold and a plastic electrically insulating molding material is molded around the portions. The mold is shaped to provide the finished distributor cap shown in FIGS. 4 and 5.

The finished distributor cap, as shown in FIGS. 4 and 5, has a top wall 80 that carries the portions 10, 18, 22, 26, 30, 34, 38, 42 and 46 and has an axially extending wall 82. The portions 10, 18, 22, 26, 30, 34, 38, 42 and 46 are molded into wall 80. The cap has nine tubular housing parts which have each been designated as 84.

It can be appreciated that in the completed distributor cap shown in FIGS. 4 and 5, the outer aluminum plating on the various portions that electrically connect a terminal to an insert are all electrically insulated from each other by the plastic cap material.

In the use of the distributor cap of this invention, the terminal 47 is connected to the secondary winding of an ignition coil by a cable. The terminals 14, 19, 23, 27, 31, 35, 39 and 43 are respectively connected to the spark plugs on an eight cylinder engine by cables. The spherical contact 72 engages a spring contact of a distributor rotor that is driven by the shaft of a distributor. The conductive insert of the rotor swings past the circumferentially spaced cap inserts 16, 36, 20, 28, 44, 24, 40 and 32 in a known manner.

The embodiments of the invention in which an exclusive property or privilege is claimed are defined as follows:

1. A distributor cap for an internal combustion engine ignition distributor comprising, a cap member formed of electrical insulating material, a plurality of radially extending supports formed of electrical insulating material carried by said cap member, each support being secured to a metallic terminal that is connectable to an external circuit and to a metallic insert that is adapted to cooperate with a distributor rotor, and an electrical conductor bonded to the outer surface of each support and extending between a said terminal and a said insert, said electrical conductor electrically connected to said metallic terminal and to said insert to thereby electrically connect said terminal and said insert.

2. The distributor cap according to claim 1 where opposed end portions of said electrical conductor are respectively bonded to said terminal and to said insert.

3. The distributor cap according to claim 1 where said supports are formed of a plastic moldable material and where the ends of each support are molded respectively to a terminal and to an insert.

4. The distributor cap according to claim 1 where said electrical conductor surrounds said support.

5. The distributor cap according to claim 1 where said electrical conductor is formed of metallic material.

6. The distributor cap according to claim 1 where said electrical conductor is formed of aluminum.

7. The distributor cap according to claim 1 where said electrical conductor is a coating of electrically conductive material that is bonded to and coats said support.

8. The distributor cap according to claim 1 where said electrical conductor is a coating of metallic material that coats said support and which coats portions of said terminal and insert.

9. An electrical conductor and terminal assembly that is adapted to be molded into the cap material of a distributor cap comprising, a support formed of electrical insulating material, a metallic insert that is adapted to cooperate with a distributor rotor secured to one end of said support, a metallic terminal secured to an opposite end of said support, and an electrical conductor bonded to the outer surface of said support extending between said terminal and said insert, said electrical conductor electrically connected to said terminal and said insert to thereby electrically connect said terminal and said insert.

10. The electrical connector and terminal assembly according to claim 9 where said support is formed of a moldable plastic material and where the opposite ends of said support are molded respectively to said terminal and to said insert.

11. The electrical connector and terminal assembly according to claim 9 where said electrical conductor has end portions that are bonded respectively to said terminal and to said insert.

12. The electrical connector and terminal assembly according to claim 9 where said electrical conductor is a coating of metallic material that coats said support and which coats portions of said terminal and said insert.

* * * * *